US006691787B2

(12) United States Patent
Amani

(10) Patent No.: US 6,691,787 B2
(45) Date of Patent: Feb. 17, 2004

(54) GAS OPERATED PUMP FOR USE IN A WELLBORE

(75) Inventor: Mohammad Amani, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 32 days.

(21) Appl. No.: 09/975,811

(22) Filed: Oct. 11, 2001

(65) Prior Publication Data

US 2002/0040785 A1 Apr. 11, 2002

Related U.S. Application Data

(60) Provisional application No. 60/239,403, filed on Oct. 11, 2000.

(51) Int. Cl.[7] ..... E21B 34/00

(52) U.S. Cl. ..... 166/377; 166/378; 166/372; 166/105; 166/322

(58) Field of Search ..... 166/322, 378, 166/66.6, 372, 377, 105, 321, 320, 332.5, 373, 374

(56) References Cited

U.S. PATENT DOCUMENTS

| | | | | | |
|---|---|---|---|---|---|
| 2,336,683 | A | | 12/1943 | Hatfield | 417/145 |
| 2,923,357 | A | * | 2/1960 | Daffin | 166/316 |
| 3,334,690 | A | * | 8/1967 | Garrett | 166/372 |
| 3,833,060 | A | | 9/1974 | Craggs et al. | 166/68 |
| 3,873,238 | A | | 3/1975 | Elfarr | 417/54 |
| 3,883,060 | A | | 5/1975 | Scarpa | 226/113 |
| 3,889,748 | A | * | 6/1975 | Tausch | 166/117.5 |
| 4,239,082 | A | * | 12/1980 | Terral | 166/117.5 |
| 4,534,414 | A | | 8/1985 | Pringle | 166/317 |
| 4,667,736 | A | * | 5/1987 | Rumbaugh et al. | 166/66.6 |
| 4,791,990 | A | * | 12/1988 | Amani | 166/372 |
| 4,901,798 | A | * | 2/1990 | Amani | 166/372 |
| 5,058,670 | A | * | 10/1991 | Crawford et al. | 166/117.6 |
| 5,325,917 | A | | 7/1994 | Szarka | 166/240 |
| 5,806,598 | A | | 9/1998 | Amani | 166/372 |
| 6,068,015 | A | | 5/2000 | Pringle | 137/155 |
| 6,206,645 | B1 | | 3/2001 | Pringle | 417/54 |
| 6,227,302 | B1 | * | 5/2001 | Pringle et al. | 166/374 |

OTHER PUBLICATIONS

International Search Report from the European Patent Office for International Appl. No. PCT/GB01/04535, dated Apr. 15, 2002.

"Subsurface Safety Accessory Equipment," Halliburton, pp. 4–12–4–13, (undated).

"Basic Camco Side Pocket Mandrel Designs," Camco Products and Services, pp. 63–66 (undated).

* cited by examiner

*Primary Examiner*—David Bagnell
*Assistant Examiner*—Matthew J Smith
(74) *Attorney, Agent, or Firm*—Moser, Patterson & Sheridan, L.L.P.

(57) ABSTRACT

The present invention generally provides a gas operated pump having a removable and insertable valve. In one aspect, the invention includes a pump housing having a fluid path for pressurized gas and a second fluid path for exhaust gas. The fluid paths are completed when the valve is inserted into a longitudinal bore formed in the housing.

24 Claims, 6 Drawing Sheets

GAS OPERATED PUMP FOR USE IN A WELLBORE

RELATED APPLICATIONS

This application claims benefit of U.S. provisional patent application, Ser. No. 60/239,403, filed Oct. 11, 2000, which is herein incorporated by reference.

BACKGROUND OF THE INVENTION

1. Field of the Invention

The present invention relates to artificial lift for hydrocarbon wells. More particularly, the invention relates to gas operated pumps for use in a wellbore. More particularly still, the invention relates to a gas operated pump having a removable valve insertable in a housing with fluid pathways in the housing that operate in conjunction with the valve.

2. Description of the Related Art

Oil and gas wells include a wellbore formed in the earth to access hydrocarbon-bearing formations. Typically, a borehole is initially formed and thereafter the borehole is lined with steel pipe, or casing in order to prevent cave in and facilitate the isolation of portions of the wellbore. To complete the well, at least one area of the wellbore casing is perforated to form a fluid path for the hydrocarbons to enter the wellbore. In some instances, natural formation pressure is adequate to bring production fluid to the surface for collection. More commonly however, some form of artificial lift is necessary to retrieve the fluid.

Artificial lift methods are numerous and include various pumping arrangements. One common pump is a gas operated pump, as shown in FIG. 1. FIG. 1 is a section view of a wellbore with a gas operated pump disposed therein. The pump 30 is located adjacent perforations in the wellbore 10. The pump operates with pressured gas injected from a high pressure gas vessel 24 into a gas supply line 80 to a valve assembly 40 disposed in a body of the pump 30. The valve assembly 40 consists of an injection control valve 70 for controlling the input of gas into a accumulation chamber 34 and a vent control valve 90 for controlling the venting of gas from the chamber 34. Operational power is brought to the valve assembly 40 by input lines 75, 77. The pump 30 has a first one-way valve 36 at the lower end 38 of the chamber 34. An aperture 37 at the lower end 38 of the chamber permits formation fluid to flow through open valve 36 to enter the chamber 34. After the chamber 34 is filled with formation fluid, the vent control valve 90 closes and the injection control valve 70 opens. Gas from the gas supply line 80 is allowed to flow through the open injection control valve 70 into the chamber 34. As gas enters the chamber 34, gas pressure forces the formation fluid downward, thereby closing the first one-way valve 36. As the gas pressure increases, formation fluid therebelow is urged into outlet 42 and opens a second one-way valve 47. Fluid enters the valve 47 and travels along passageway 32 and into the tubing string 20. After formation fluid is displaced from the chamber 34, the injection control valve 70 is closed, thereby restricting the flow of gas from the high pressure gas vessel 24.

Hydrostatic fluid pressure in the passageway 32 acts against second one-way valve 47, thereby closing the valve 47 and preventing fluid from entering the chamber 34. The vent control valve 90 is opened to allow gas in the chamber 34 to exit a vent line 100 into an annulus 22 formed between the casing 12 and the tubing string 20. As the gas vents, the gas pressure decreases thereby reducing the force on the valve 36. At a point when the formation fluid pressure is greater than the gas pressure in the chamber 34 the valve 36 opens thereby allowing formation fluid to once again fill the chamber 34. In this manner, a pump cycle is completed. As the gas operated pump 30 continues to cycle, formation fluid gathers in the tubing string 20 and eventually reaches the surface of the well for collection.

U.S. Pat. No. 5,806,598 to Mohammad Amani, incorporated herein by reference in its entirety, discloses a method and apparatus for pumping fluids from a producing hydrocarbon formation utilizing a gas operated pump having a valve actuated by a hydraulically actuation mechanism. In one embodiment, a valve assembly is disposed at an end of coiled tubing and may be removed from the pump for replacement.

The conventional pumps illustrated in FIG. 1 and described in the '598 patent suffer from problems associated with size limitations in downhole pumps. These valve assemblies for a gas operated pump have an internal bypass passageway for injecting gas into the chamber. The internal bypass passageway must be a large enough diameter to facilitate a correct amount of gas flow into the chamber. These internal structures necessarily make the valve large and bulky. A bulky valve assembly is difficult to insert in a downhole pump because of space limitations in a wellbore and in a pump housing.

There is a need, therefore, for a gas operated pump having a valve assembly that is less bulky. There is a further need for a gas operated pump with a removable valve that does not include a bypass passageway.

SUMMARY OF THE INVENTION

The present invention generally provides a gas operated pump having a removable and insertable valve. In one aspect, the invention includes a pump housing having a fluid path for pressurized gas and a second fluid path for exhaust gas. The fluid paths are completed when the valve is inserted into a longitudinal bore formed in the housing.

BRIEF DESCRIPTION OF THE DRAWINGS

So that the manner in which the above embodiments of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 2:
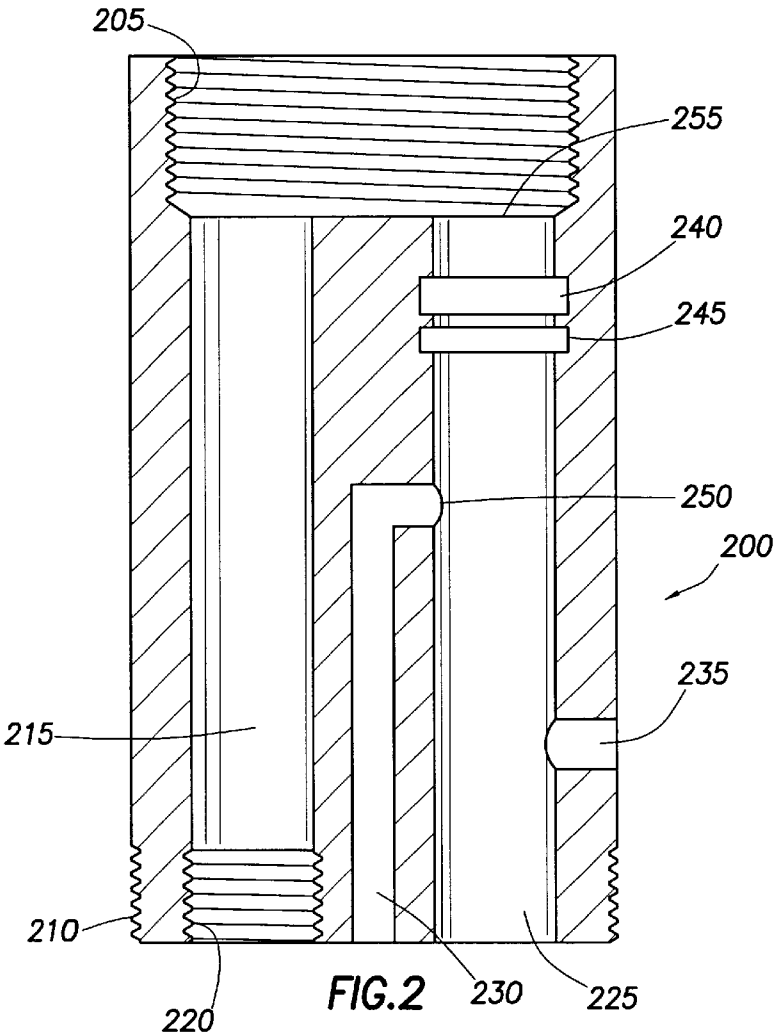
FIG. 2 is a section view showing a housing having a first and second fluid paths formed therein.

FIG. 2 is a section view showing a housing 200 of a gas operated pump. In a preferred embodiment, the housing includes two longitudinal bores as well as a number of internally formed motive fluid paths to operate a valve and to direct gas through the pump. The housing 200 includes a first threaded portion 205 formed in an interior of an upper end for connection to a string of tubulars (not shown) and a second threaded portion 210 on the exterior of a lower end for connection to an accumulation chamber (not shown). The housing 200 includes a first longitudinal bore 215 therethrough having an internal threaded portion 220 at a lower end for connection to a diptube (not shown). In use, the bore 215 serves as a conduit for production fluid pumped towards the surface of the well. The housing also includes a second longitudinal bore 225. An aperture 235 formed in a wall of the housing provides communication between the second longitudinal bore 225 and an exterior of the housing 200. A third bore 230 provides communication between an injection port 250 in a wall of the second longitudinal bore 225 and a lower end of the housing 200 for injection of pressurized gas into the accumulation chamber (not shown).

The second longitudinal bore 225 further includes a first 240 and a second 245 profile formed in an interior of the bore 225 to receive a removable valve assembly (not shown) that is inserted in an upper end 255 of bore 225. In the preferred embodiment, the profiles 240, 245 are continuous grooves and are formed to permit mating formations of the valve assembly to mate therewith as will be more fully described herebelow.

Figure 1:
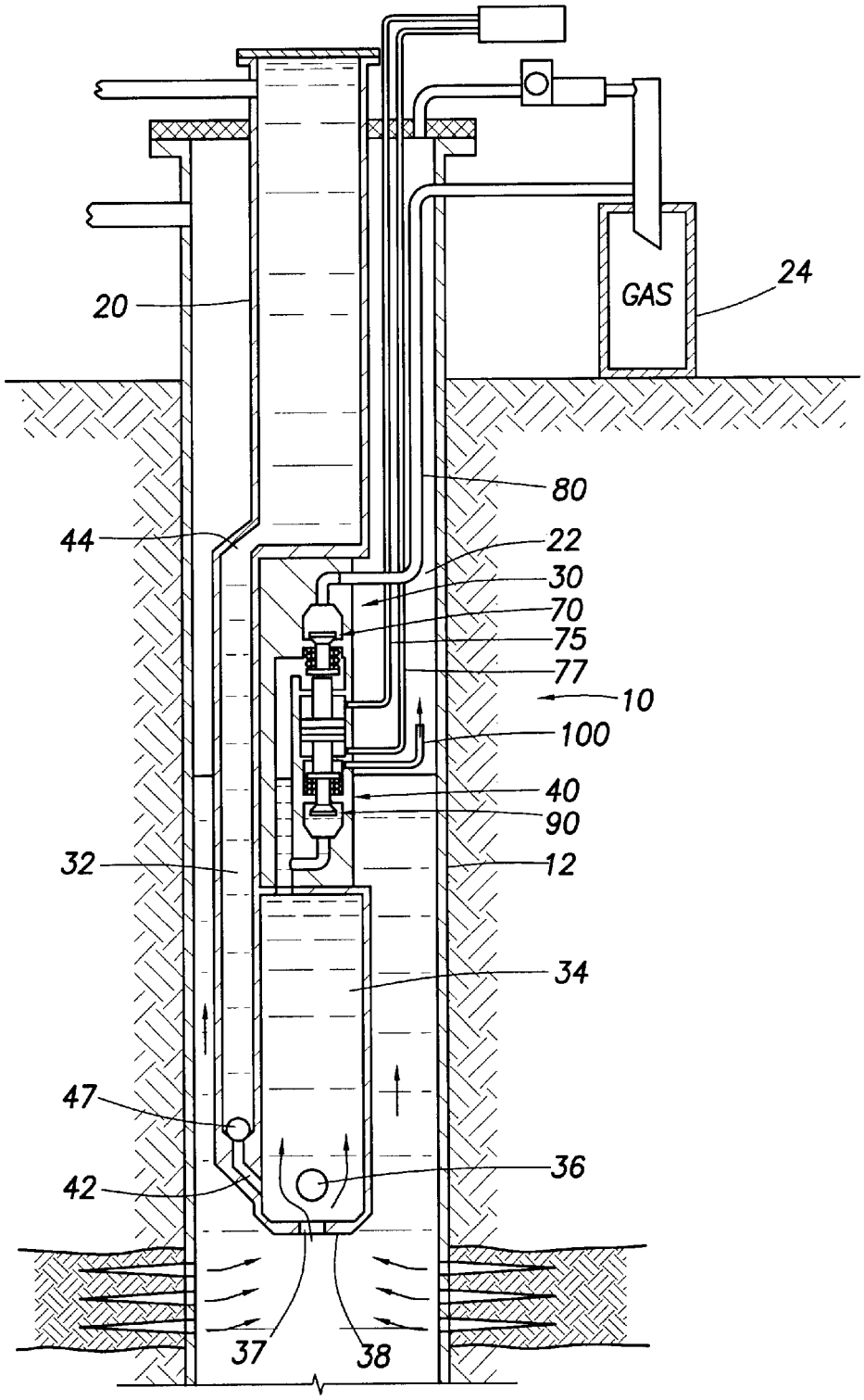
FIG. 1 (PRIOR ART)
FIG. 1 is a cross section view of a prior art gas operated pump assembly in a well.
Figure 3:
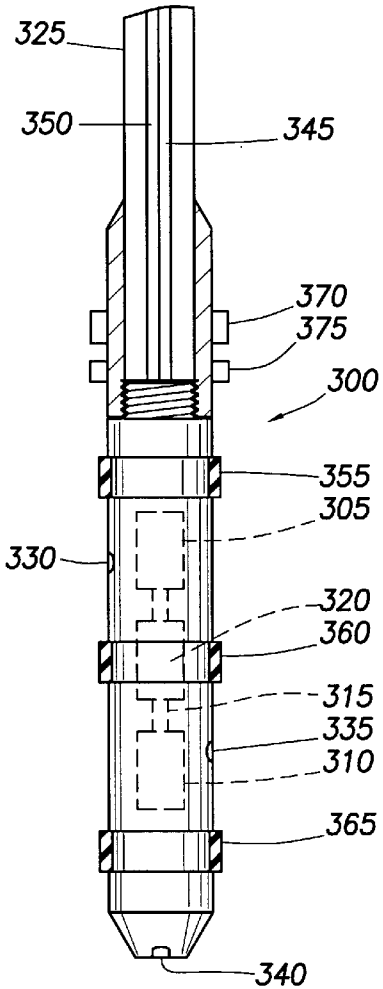
FIG. 3 illustrates the removable valve assembly disposed on a coiled tubing string.

FIG. 3 illustrates the removable valve assembly 300 disposed on the end of a coiled tubing string 325. The removable valve assembly 300 includes an inlet control valve 305, a vent control valve 310, a valve stem 315 and an actuator 320. The valve stem 315 is connected to both the inlet control valve 305 and the vent control valve 310. The actuator 320 moves the valve stem 315, alternatively opening and closing the inlet control valve 305 and the vent control valve 310. When the inlet control valve 305 is in the open position, gas flows down a coiled tubing string 325 into the assembly 300 and out through a gas outlet port 330. Alternatively, when the vent control valve 310 is in the open position, gas enters a vent inlet port 340 and exits a vent outlet port 335. A first 345 and a second 350 control conduits are housed inside the coiled tubing string 325. The first 345 and the second 350 control conduits are typically hydraulic control lines and are used to actuate the valve assembly 300. Additionally, electric power can be transmitted through the one or more control conduits 345, 350 to actuate the valve assembly 300. Valve assembly 300 may include data transmitting means to transmit data such as pressure and temperature within the pump chamber through the one or more control conduits 345, 350 to the surface of the wellbore. In these instances, the valve assembly 300 or the housing 200 may include sensors. Data transmitting means can include fiber optic cable.

A first 355, second 360, and third 365 seals are circumferentially mounted around an external surface of a valve assembly 300. The purpose of the seals is to isolate fluid paths between the valve assembly 300 and the housing (FIG. 2) when the valve assembly 300 is inserted therein. The assembly 300 further includes a first 370 and a second 375 key to secure the valve assembly 300 axially within the housing. The first 370 and the second 375 keys are outwardly biased and are designed to mate with the profiles in the interior surface of the housing (FIG. 2).

Figure 4:
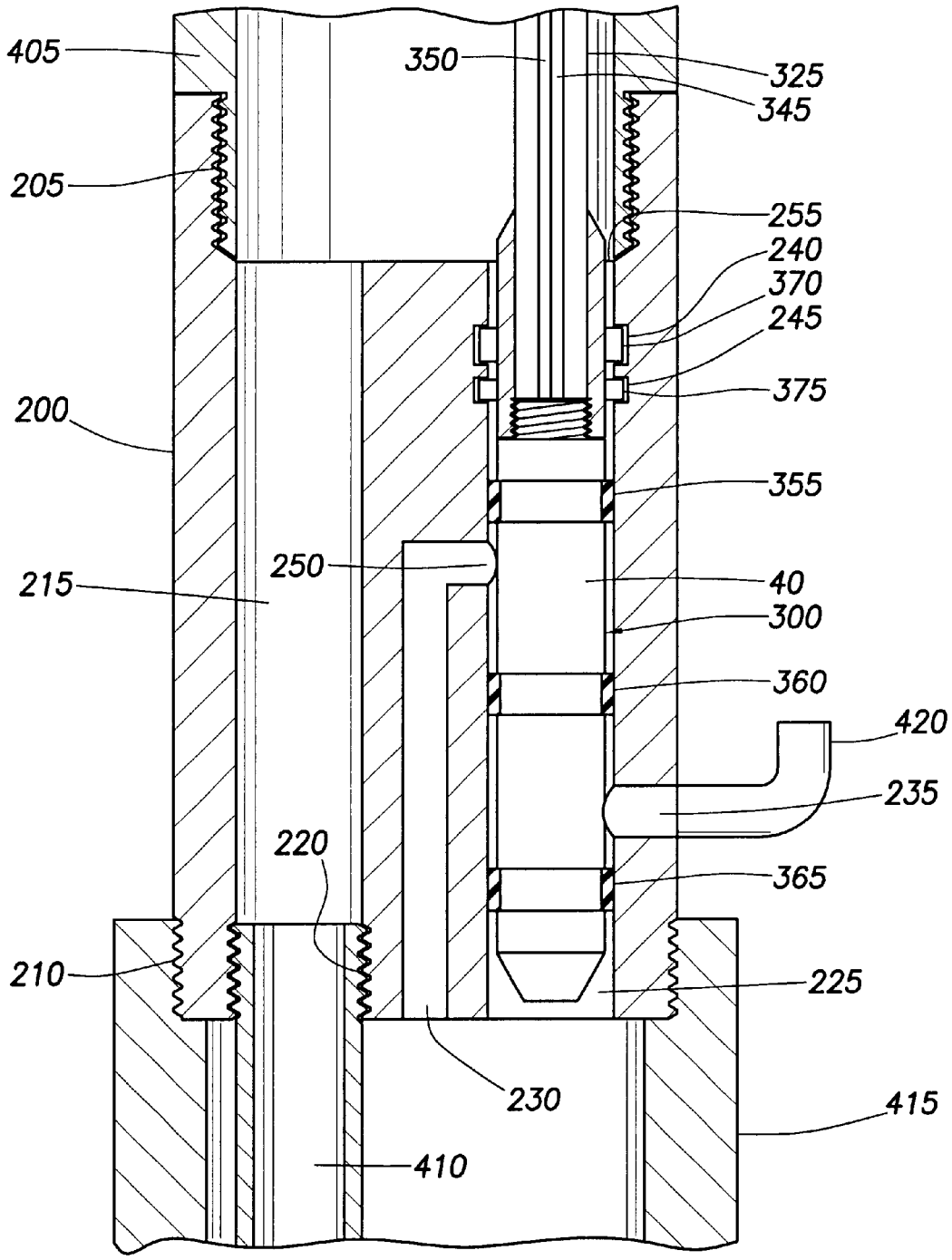
FIG. 4 is a section view showing the removable valve assembly disposed on coiled tubing and located in the bore of the housing.

FIG. 4 is a section view of the valve assembly 300 disposed in the housing 200. In the embodiment of FIG. 4, the valve assembly 300 is shown at the end of the string of coiled tubing 325 that provides a source of pressurized gas to operate the pump. An accumulator chamber 415 for collecting formation fluid is secured to the housing 200 by the second threaded portion 210 at the lower end. A tubing string 405 is secured to the housing 200 at the first threaded portion 205. A diptube 410 is secured to the housing 200 at internal threaded portion 220 of the first longitudinal bore 215. A vent line 420 is secured to the housing 200 at the aperture 235 to provide a passageway for gas venting from the chamber 415.

In operation, the removable valve assembly 300 is installed at an end of the coiled tubing string 325 and the string 325 is inserted in tubing string 405 at the top of the wellbore. As the valve assembly 300 reaches the housing 200, a profile means and guide orient and align the valve assembly 300 with the second longitudinal bore 225 which is offset from the center of the housing 200. Profile means and guides are well known in the art and typically include some mechanical means for orienting a device in a wellbore. After insertion into the upper end 255 of the bore 225, the valve assembly 300 is urged downwards until the first 370 and the second 375 keys of the valve assembly 300 are secured in place in the first 240 and the second 245 profiles of the housing 200. Mating angles on the keys and profiles permit the retention of the valve in the housing 200. The first seal 355 and the second seal 360 form a barrier on the top and bottom of the injection port 250 to prevent leakage of injected gas into the accumulator chamber 415. The second seal 360 and the third seal 365 provide a barrier on the top and bottom of the aperture 235 to prevent leakage of gas exiting the vent line 420.

Figure 5:
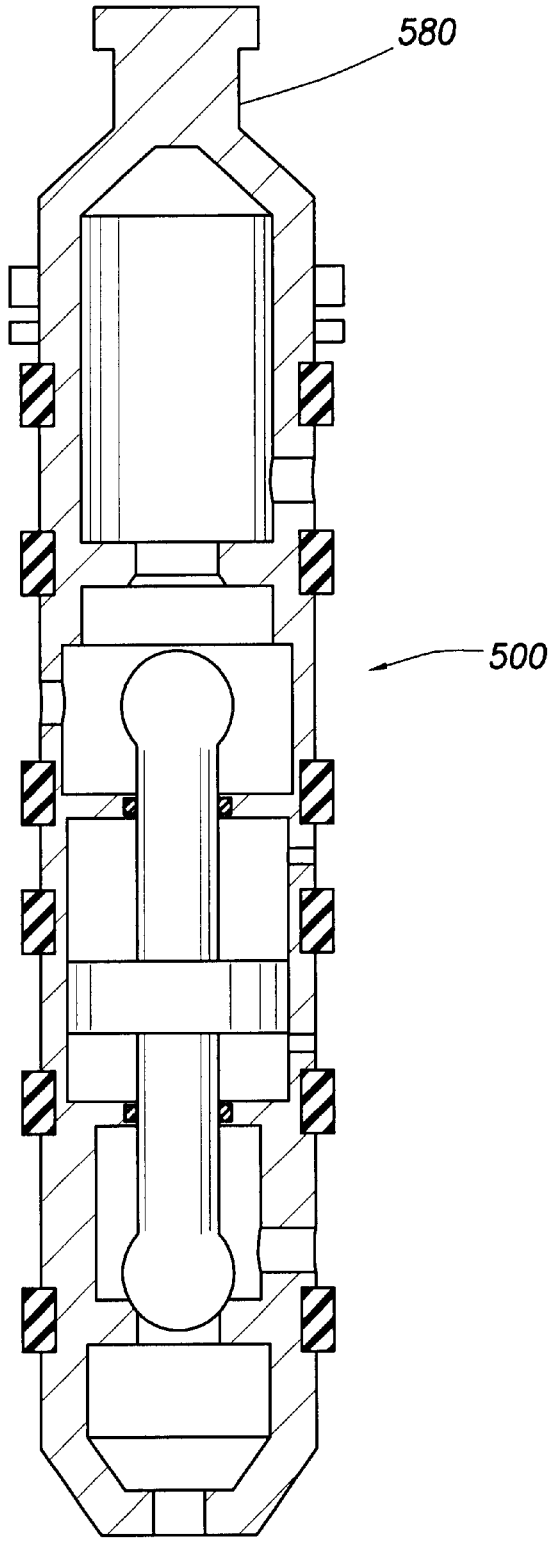
FIG. 5 illustrates another embodiment of a removable valve assembly for a gas operated pump.
Figure 6:
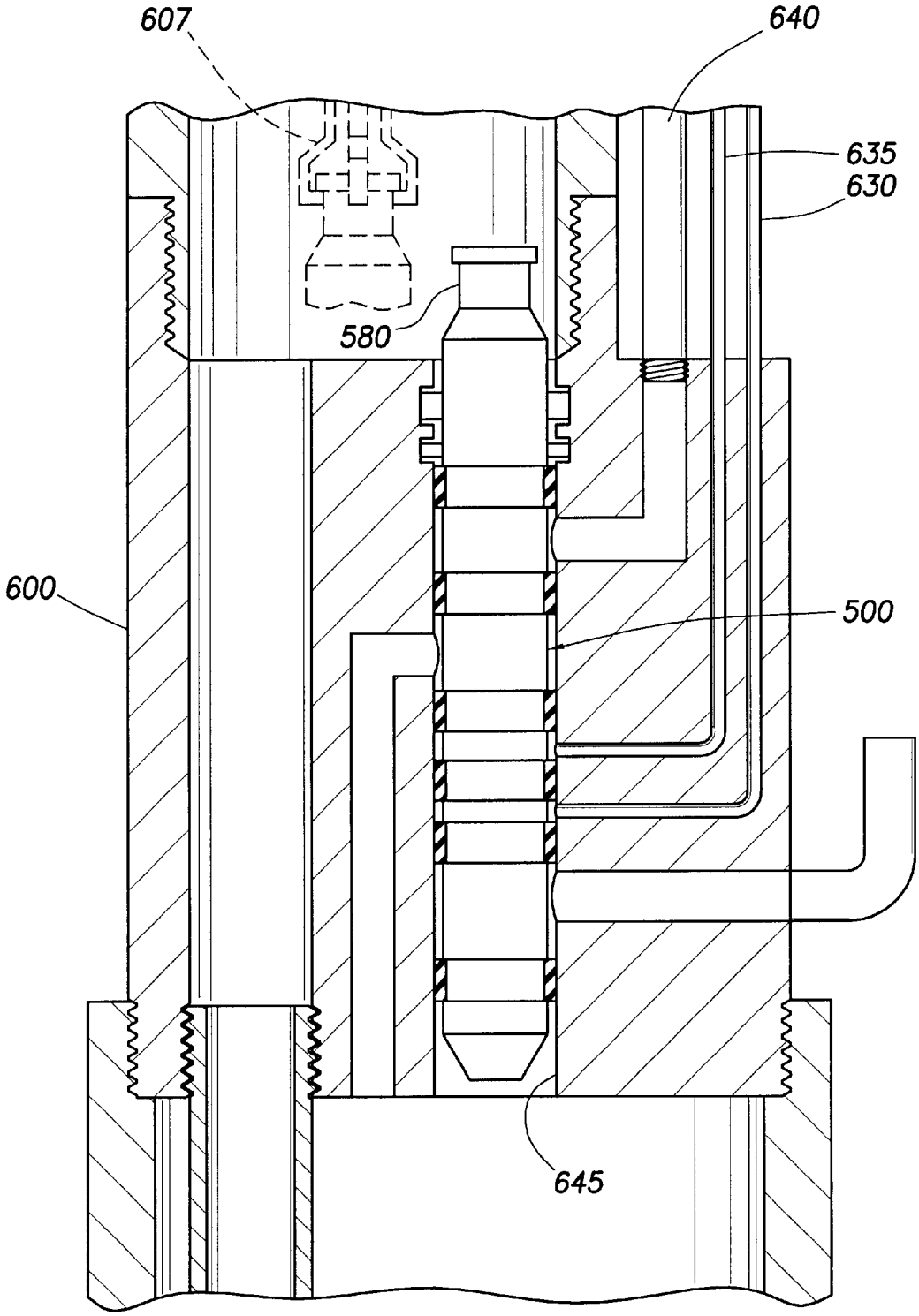
FIG. 6 illustrates the valve assembly of FIG. 5 in a housing with an alignment tool to install the valve in the housing.

FIG. 5 is a section view of an alternative embodiment of a valve assembly 500 and FIG. 6 is a section view of the valve assembly 500 installed in a housing 600. The housing 600 of FIG. 6 includes additional fluid paths formed therein. Hydraulic conduits 630, 635 are formed in the housing 600 and serve to carry hydraulic power fluid from an upper end of the housing 600 to the longitudinal bore 645 formed in the housing 600. The lines intersect the bore 645 at a location ensuring they will communicate with the valve assembly 500 after it has been installed in the bore 645 and is retained therein with the retention means described with respect to FIG. 4. Also formed in the housing 600 is an internal gas line 640 providing communication between the upper end of the housing 600 and the bore 645.

By providing hydraulic conduits 630, 635 and gas line 640 internally within the housing 600, there is no need for separate hydraulic lines or a gas supply line to remain attached at an upper end of the valve assembly 500. As illustrated in FIG. 6, the valve assembly 500 is installed in bore 645 with a selective connector or gripping tool 607 that temporarily retains the valve assembly 500 by gripping a fish neck 580 formed at the upper end of the valve assembly 500. Gripping tools typically operate mechanically with inwardly movable fingers. A kickover tool can be utilized to align the valve assembly 500 with the offset bore 645. Kickover tools and gripping tools are well known in the art. Because no rigid conduits are needed between the surface of the well and the upper end of the valve assembly 500, the assembly 500 can be inserted and removed from the housing using wireline or even slick line.

Figure 7:
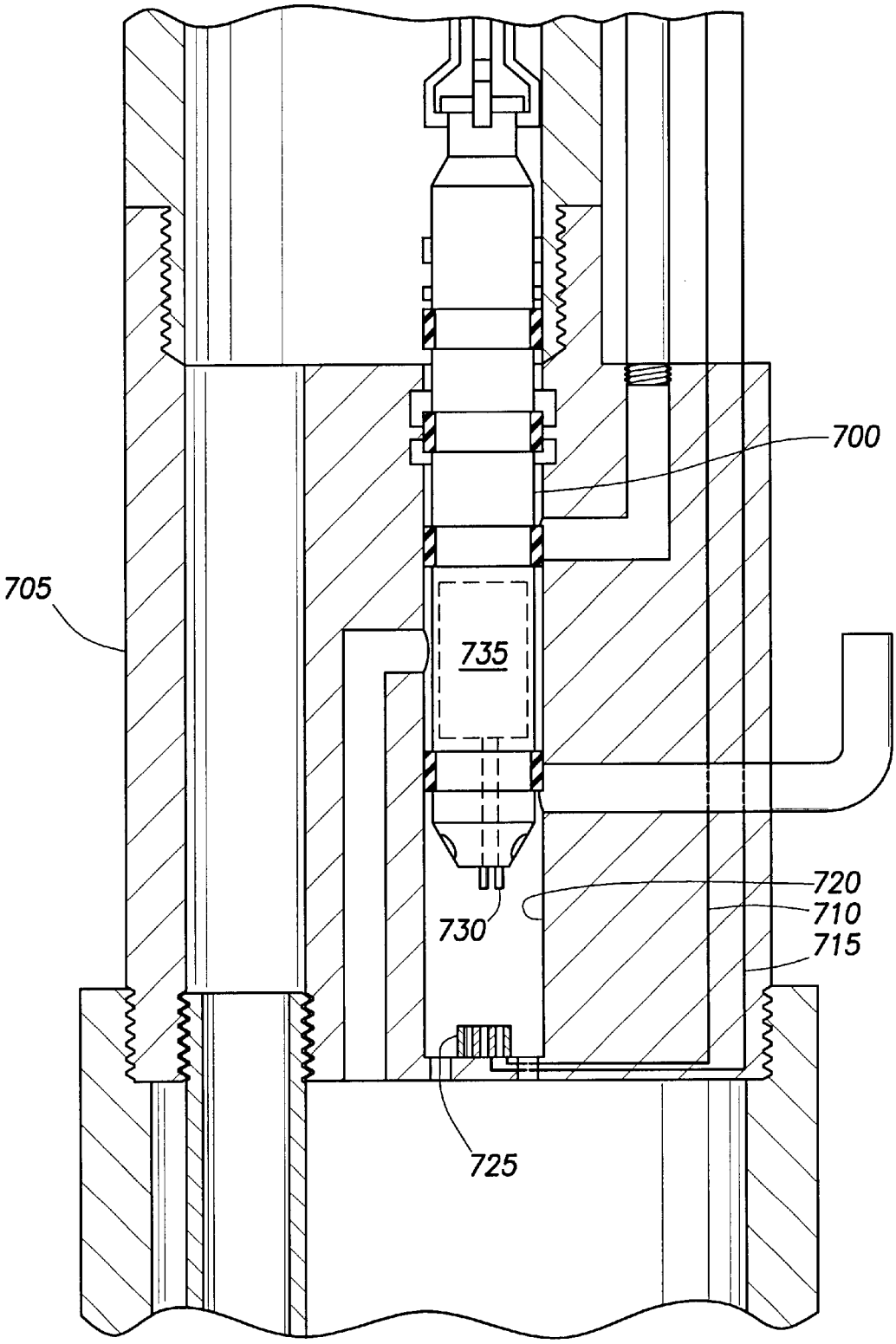
FIG. 7 illustrates a removable valve assembly and a housing with an electrical connection means therebetween housing.

FIG. 7 is a section view of a removable valve assembly 700 in a pump housing 705 with an electrical connection therebetween. For clarity, the assembly 700 is illustrated partially inserted in the housing 705. In the embodiment of FIG. 7, the housing 705 is electrically wired with conductors 710, 715 that lead to a lower portion of the longitudinal bore 720. A contact seat 725 is located within the bore 720 and is constructed and arranged to receive an electrode 730 protruding from a lower end of the valve assembly 700. As the assembly 700 is inserted into the bore 720 and is axially located therein, the electrode 730 is seated in the contact seat 725 and an electrical connection between the housing 705 and the valve assembly 700 is made. Thereafter, the valve assembly 700 may be actuated electrically through the use of a solenoid switch 735 disposed within the valve assembly 700. As with the other embodiments of the invention, the housing includes flow paths formed therein that communicate with the valve assembly 700 and reduce the necessary bulk of the valve assembly 700.

While the foregoing is directed to embodiments of the present invention, other and further embodiments of the invention may be devised without departing from the basic scope thereof, and the scope thereof is determined by the claims that follow.

What is claimed is:

1. A fluid operated pump for use in a wellbore, the pump comprising:

a housing with at least one longitudinal bore therethrough;

a fluid path formed in the housing, the fluid path for communicating a pressurized fluid from the bore to an accumulation chamber of the pump below the housing;

a second fluid path formed in the housing, the second fluid path for communicating an exhaust fluid from the accumulation chamber below the housing to an exterior of the housing; and a removable valve, the valve insertable into the bore and constructed and arranged to selectively complete the first and second fluid paths and to selectively direct the pressurized fluid and the exhaust fluid.

2. The pump of claim 1, further including first and second motive fluid paths formed in the housing, the first and second motive fluid paths for communicating motive fluid to the bore in order to operate the valve.

3. The pump of claim 1, wherein the first fluid path further includes a path extending from the bore to an area above the housing for communicating the pressurized fluid from the area above the housing to the bore.

4. The pump of claim 1, further including at least one seal member between the valve and the bore, the at least one seal member isolating the first and second fluid paths from each other.

5. The pump of claim 4, further including a retention assembly between the valve and the bore, the retention assembly retaining the valve in a predetermined axial position with respect to the bore.

6. The pump of claim 5, wherein the retention assembly includes at least one outwardly biased formation extending radially from an outer surface of the valve, the at least one formation constructed and arranged to land in a profile formed on an inner surface of the bore, whereby upon insertion in the bore, the valve seats in the bore in a predetermined axial position.

7. The pump of claim 6, wherein the first and second fluid paths are interruptably completed when the valve is in the predetermined axial position within the bore.

8. The pump of claim 1, wherein the removable valve includes a coiled tubing string extending from an upper end thereof, the string serving as a conduit for the pressurized fluid.

9. The pump of claim 1 wherein the pump further includes an electrical connection between the valve and the bore, the electrical connection usable to shift the valve between a first and a second position.

10. The pump of claim 9, wherein the electrical connection is made between a first mating member on the valve and a second mating member disposed in the bore, the members combining as the valve is located in a predetermined axial position within the bore.

11. The pump of claim 10, wherein the removable valve is shifted electrically.

12. The pump of claim 1, wherein the valve is insertable into the bore on a tubing string, the string thereafter releasable through the use of a selective connector between an upper portion of the valve and the lower end of the tubing string.

13. The pump of claim 12, wherein the selective connector is operable from the surface of the well.

14. The pump of claim 13, further including an alignment member constructed and arranged to align the valve with the bore prior to insertion of the valve into the bore.

15. A method of inserting a removable valve into a fluid operated pump in a wellbore, comprising:

positioning the valve on a conveyance member and conveying the valve to a location in the wellbore approximate a longitudinal bore formed in the pump;

aligning the valve with the bore;

inserting the valve in the bore to selectively direct a pressurized fluid and an exhaust fluid to and from an accumulation chamber;

completing at least one fluid path between fluid conduits formed in the housing;

retaining the valve in the bore; and sealing the valve in the bore.

16. The method of claim 15, further including disconnecting the conveyance member from the valve and leaving the valve in the bore.

17. The method of claim 16, further including making an electrical connection between the valve and the bore.

18. A method of removing a removable valve from a fluid operated pump in a wellbore comprising:

inserting a selective connector into a wellbore;

positioning the connector proximate an upper end of the removable valve;

selectively connecting the connector to the upper portion of the valve;

applying a force to the connector adequate to discomplete at least one fluid path between the valve and a conduit formed in the housing, thereby removing fluid communication between the valve and an accumulation chamber of the pump; and raising the connector and valve to a surface of the well.

19. An insertable valve for use in a downhole fluid operated pump, the valve comprising:

a valve body, the valve body having at least one fluid path therethrough and constructed and arranged to complete a fluid path when placed in alignment with at least one fluid path formed in a pump housing and to selectively direct a pressurized fluid and an exhaust fluid to and from an accumulation chamber.

20. A fluid operated pump for use in a wellbore, the pump comprising:

a housing with at least one longitudinal bore therethrough;

a fluid path formed in the housing, the fluid path for communicating a pressurized fluid from the bore to an area of the pump below the housing;

a second fluid path formed in the housing, the second fluid path for communicating an exhaust fluid from an area below the housing to an exterior of the housing;

a removable valve, the valve insertable into the bore and constructed and arranged to selectively complete the first and second fluid paths and to selectively direct the pressurized fluid and the exhaust fluid; and an electrical connection between the valve and the bore, the electrical connection usable to shift the valve between a first and a second position.

21. The pump of claim 20, wherein the electrical connection is made between a first mating member on the valve and a second mating member disposed in the bore, the members combining as the valve is located in a predetermined axial position within the bore.

22. The pump of claim 21, wherein the removable valve is shifted electrically.

23. A method of inserting a removable valve into a fluid operated pump in a wellbore, comprising:

positioning the valve on a conveyance member and conveying the valve to a location in the wellbore approximate a longitudinal bore formed in the pump;

aligning the valve with the bore;

inserting the valve in the bore;

completing at least one fluid path between fluid conduits formed in the housing;

retaining the valve in the bore;

sealing the valve in the bore;

disconnecting the conveyance member from the valve and leaving the valve in the bore; and making an electrical connection between the valve and the bore.

24. A fluid operated pump for use in a wellbore, the pump comprising:

a housing with at least one longitudinal bore therethrough;

a fluid path formed in the housing, the fluid path for communicating a pressurized fluid from the bore to an accumulation chamber;

a second fluid path formed in the housing, the second fluid path for communicating an exhaust fluid from the accumulation chamber to an exterior of the housing; and a removable valve, the valve insertable into the bore and constructed and arranged to alternately direct the pressurized fluid and the exhaust fluid.

* * * * *